US008585287B2

(12) United States Patent
Coonce et al.

(10) Patent No.: US 8,585,287 B2
(45) Date of Patent: Nov. 19, 2013

(54) BAG

(75) Inventors: Ryan J. Coonce, Palatine, IL (US); Michael G. Borchardt, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 13/494,844

(22) Filed: Jun. 12, 2012

(65) Prior Publication Data

US 2012/0251018 A1 Oct. 4, 2012

Related U.S. Application Data

(63) Continuation of application No. 12/638,778, filed on Dec. 15, 2009, now Pat. No. 8,282,279.

(60) Provisional application No. 61/143,655, filed on Jan. 9, 2009.

(51) Int. Cl.
*B65D 33/16* (2006.01)
*A44B 1/04* (2006.01)

(52) U.S. Cl.
USPC ..... 383/63; 24/400; 24/DIG. 50

(58) Field of Classification Search
USPC ..... 383/63; 24/399, 400, 585.12, DIG. 50
See application file for complete search history.

(56) References Cited

U.S. PATENT DOCUMENTS

| | | | | |
|---|---|---|---|---|
| 4,829,641 | A * | 5/1989 | Williams | 24/585.12 |
| 5,509,734 | A * | 4/1996 | Ausnit | 383/63 |
| 5,689,866 | A * | 11/1997 | Kasai et al. | 24/585.12 |
| 5,774,955 | A * | 7/1998 | Borchardt et al. | 24/584.1 |
| 7,543,361 | B2 * | 6/2009 | Borchardt et al. | 24/399 |
| 7,674,040 | B2 * | 3/2010 | Dowd et al. | 383/61.2 |
| 8,075,186 | B2 * | 12/2011 | Borchardt et al. | 383/63 |
| 8,215,839 | B2 * | 7/2012 | Borchardt et al. | 383/63 |
| 8,282,279 | B2 * | 10/2012 | Coonce et al. | 383/63 |

* cited by examiner

*Primary Examiner* — Jes F Pascua
(74) *Attorney, Agent, or Firm* — Thomas C. Feix

(57) ABSTRACT

The bag may include a first sidewall, a second sidewall, a first fastening strip and a second fastening strip. The fastening strips may include a base portion having a pair of spaced-apart webs extending from the base portion. The webs may include hook portions extending from the webs. The fastening strips may have wide base portions. The fastening strips may have thick base portions. The fastening strips may provide a greater surface area for the user to apply a force during the occlusion process and may reduce the occlusion effort. The fastening strips may have a lower occlusion force. The fastening strips may provide improved alignment of the fastening strips. The fastening strips may have an improved perception of seal security with a high opening force and/or a high peel force.

13 Claims, 13 Drawing Sheets

BAG

CROSS-REFERENCE TO RELATED APPLICATIONS

This Continuation Application claims the benefit of U.S. application Ser. No. 12/638,778, filed Dec. 15, 2009, now U.S. Pat. No. 8,282,279, which claims the benefit of U.S. Provisional Application No. 61/143,655, filed Jan. 9, 2009, both of which are hereby incorporated by reference in their entirety.

BACKGROUND

Among their many applications, thermoplastic bags may be used to receive and store food items. Such bags are typically made from pliable thermoplastic sidewalls that are overlaid and joined together along their edges to provide an interior volume that may receive the food items to be stored. The interior volume is accessible via an opening. To seal closed the opening, the bag may include interlocking closure strips attached proximate the opening.

BRIEF SUMMARY

The bag may include a first sidewall and an opposing second sidewall overlaid and joined to the first sidewall to provide an interior volume. The interior volume is accessible via an opening. To seal closed the opening after inserting food items into the interior volume, the bag may include first and second interlocking fastening strips. The first fastening strip may include a first closure element. The second fastening strip may include a second closure element for engaging the first closure element.

The first closure element may include a base portion having a pair of spaced-apart webs extending from the base portion. The webs may include hook portions extending from the webs, respectively, and facing towards each other. The second closure element may include a base portion including a pair of spaced-apart webs extending from the base portion. The webs may include hook portions extending from the webs, respectively, and facing away from each other. The fastening strips may have wide bases. The fastening strips may have thick bases.

To engage the first and second fastening strips, an occlusion force is applied to the fastening strips. The occlusion force may be a user utilizing his or her fingers to press the fastening strips together. The fastening strips may be separated by applying an opening force. The opening force may be a user utilizing their fingers to grasp the tops of the sidewalls with their fingers and pulling outward. After the user disengages the upper and lower hooks, the bag may have a small opening and the fastening strips to the left and right of the opening may be engaged or occluded. In order to enlarge the opening, the user will apply a peeling force which will cause the fastening strips to the left and/or right of the opening to disengage or deocclude.

Some users may roll the closure open rather than pulling the closure open. The wide base may provide the user with greater leverage to roll the closure elements apart.

A possible advantage of the wide fastening strips may be ease in occluding the fastening strips. The wide fastening strips provide a greater surface area for the user to apply a force during the occlusion process.

Another possible advantage of the fastening strips may be improved occlusion. The thick bases of the fastening strips may allow the occlusion force to be transmitted over a larger area, thereby may reduce the occlusion effort.

Another possible advantage of the wide fastening strips may be a reduced occlusion effort. The occlusion effort may include the amount of effort which a user expends in trying to keep their fingers on the fastening strips as the user is occluding the fastening strips. When the fastening strips are wide, the user expends less effort in trying to keep their fingers on the fastening strips in comparison to the effort required in trying to keep their fingers on fastening strips which are narrower in width.

Another possible advantage of the fastening strips may be a reduced occlusion force. The reduced occlusion force may be provided by the wide fastening strips. The wide fastening strips may exhibit reduced resistance to bending during the occlusion process and thus may allow for easier occlusion.

Another possible advantage of the fastening strips may be improved alignment. The improved alignment may be provided by the wide fastening strips, the spacing between the webs, the geometry of the closure elements, and/or the thick base of the fastening strips.

Another possible advantage of the fastening strips may be improved perception of seal security. The user perceives seal security by the opening force of the fastening strips and the peel force of the fastening strips. The fastening strips may have a high opening force and a high peel force. Thus, the user may have an improved perception of seal security.

Another possible advantage of the fastening strips may be an improved balance of seal security (higher opening force) and ease of occlusion (lower occlusion force, ease of alignment and reduced occlusion effort).

A high speed manufacturing process may be employed that processes a planar, continuous web of thermoplastic material into the finished bags. The process may apply the fastening strips to the web.

These and other advantages and features of the bag with patterning will become apparent from the description and the accompanying drawings.

DESCRIPTION

Figure 1:
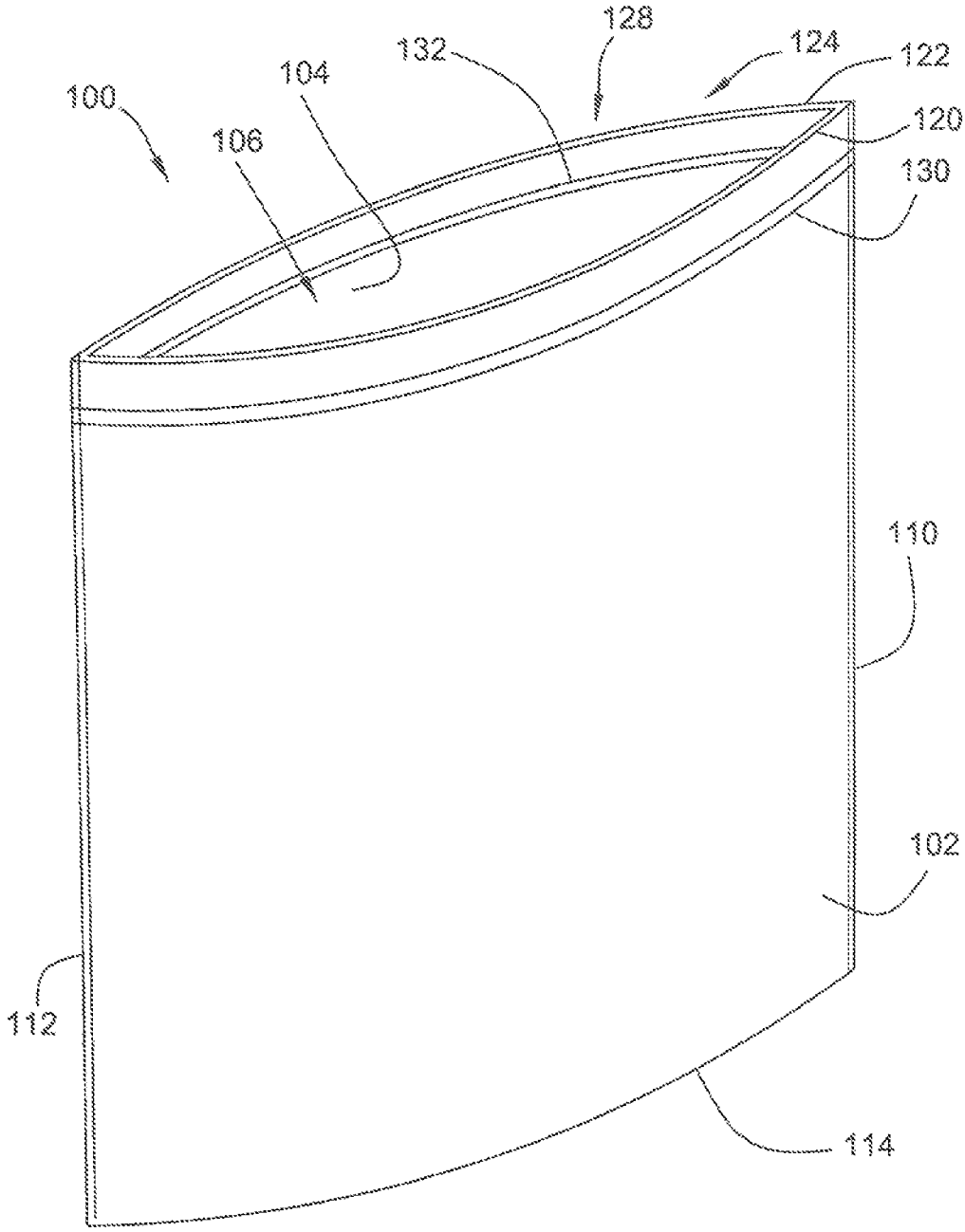
FIG. 1 is a perspective view of a bag.

Referring to FIG. 1, an embodiment of a thermoplastic bag 100 is illustrated. The bag 100 may include a first sidewall 102 of pliable thermoplastic material and an opposing second sidewall 104 overlaying and joined to the first sidewall to delineate an interior volume 106. The sidewalls 102, 104 may be rectangular in shape and may be joined along a first side edge 110, a second side edge 112, and a closed bottom edge 114 extending between the first and second side edges 110, 112. However, in other embodiments, the sidewalls may have other shapes, and the bag may have different numbers of edges and sidewalls. The side edges may be formed by any suitable method including, for example, heat sealing the thermoplastic material together.

To access the interior volume 106, the first and second top edges 120, 122 of the respective first and second sidewalls remain un-joined to provide an opening 124. To releasably close the opening 124 to, for example, better preserve food items, the first and second sidewalls 102, 104 may include a closure device 128. The closure device 128 may include first and second fastening strips 130, 132. The first and second fastening strips 130, 132 may be formed from extruded, flexible thermoplastic and may extend between the first and second side edges 110, 112. The first and second fastening strips 130, 132 may releasably engage to form a seal which closes the opening 124.

The first and second sidewalls 102, 104 may be formed from any suitable thermoplastic material formed or drawn into a flexible, pliable thin walled sheet or web. The thickness of the thermoplastic web may have a first range of about 0.0005 inches (0.00123 cm) to about 0.005 inches (0.0127 cm), and a second range of about 0.0018 inches (0.0046 cm) to about 0.0026 inches (0.0066 cm). In one embodiment, the thickness may be about 0.0026 inches (0.0066 cm). Examples of suitable thermoplastic materials may include polyethylenes, such as, high density polyethylene (HDPE), low density polyethylene (LDPE), linear low density polyethylene (LLDPE), polypropylene (PP), ethylene vinyl acetate (EVA), nylon, polyester, polyamide, ethylene vinyl alcohol, or other materials or combinations thereof, and may be formed in single or multiple layers. When intended for storing food items, the thermoplastic material of the bag typically may be transparent, though in other embodiments the thermoplastic material may be translucent, opaque, or tinted. Furthermore, the material used for the sidewalls may be a gas impermeable material.

Figure 3:
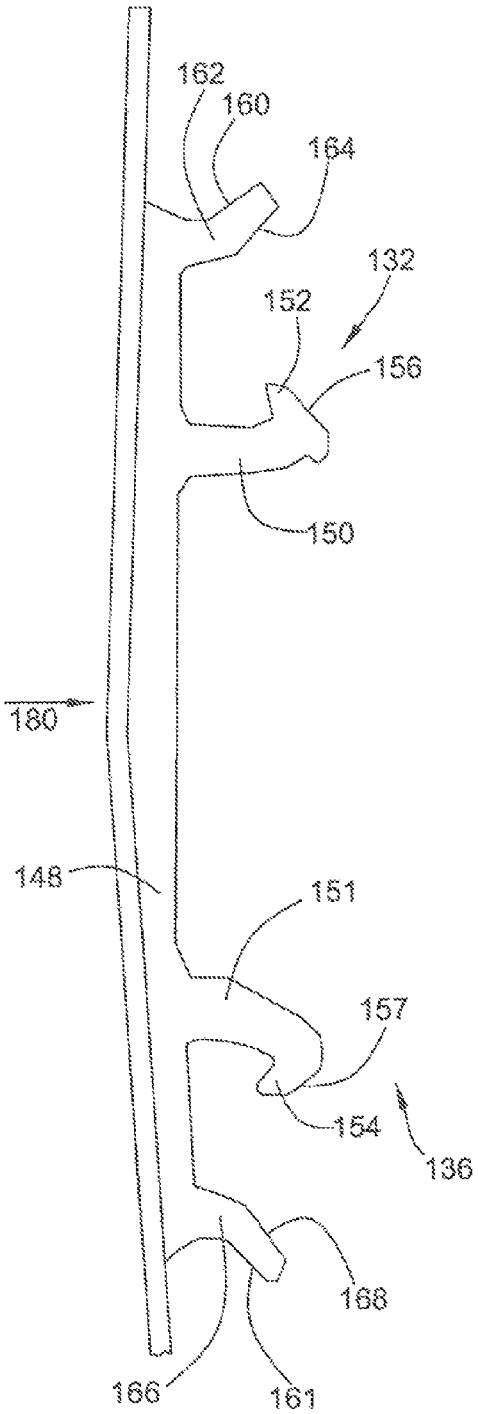
FIG. 3 is a cross-sectional view taken along line 2-2 in FIG. 1 illustrating the male fastening strip of a closure device.
Figure 2:
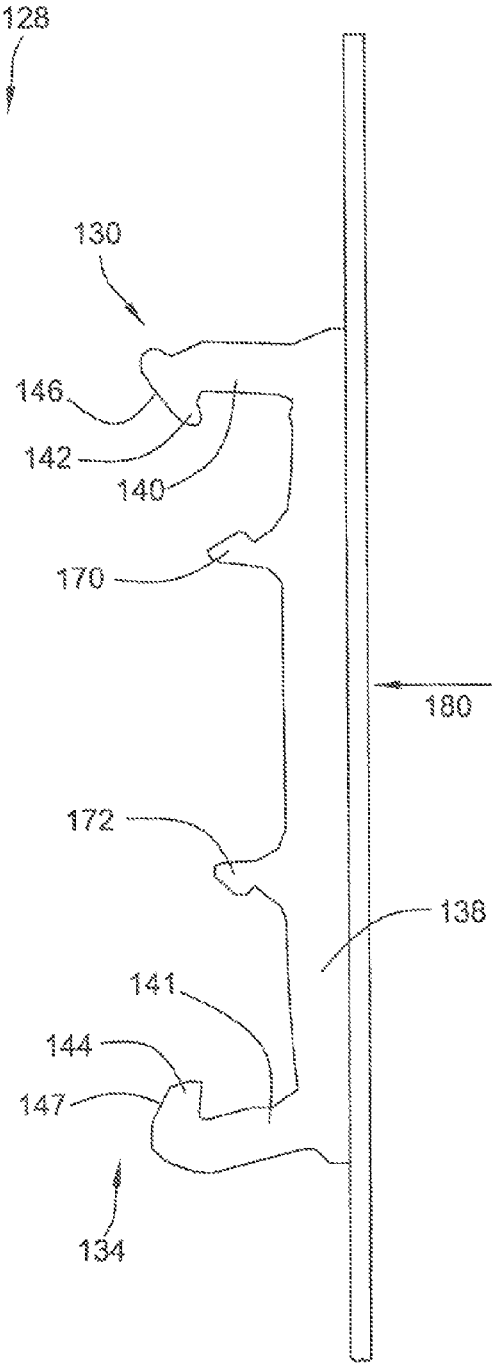
FIG. 2 is a cross-sectional view taken along line 2-2 in FIG. 1 illustrating the female fastening strip of a closure device.

FIGS. 2 and 3 together illustrate a closure device 128 according to one embodiment. The closure device 128 may include first and second fastening strips 130, 132. The first fastening strip 130 may include a first closure element 134. The second fastening strip 132 may include a second closure element 136 for engaging the first closure element 134.

The first closure element 134 may include a base portion 138 having a pair of spaced-apart webs 140, 141 extending from the base portion 138. The webs 140, 141 may include hook portions 142, 144 extending from the webs 140, 141, respectively, and facing towards each other. The hook portions 142, 144 may include guide surfaces 146, 147 which serve to guide the hook portions 142, 144 for occluding with the hook portions of a mating closure element.

The second closure element 136 may include a base portion 148 including a pair of spaced-apart webs 150, 151 extending from the base portion 148. The webs 150, 151 may include hook portions 152, 154 extending from the webs 150, 151, respectively, and facing away from each other. The hook portions 152, 154 include guide surfaces 156, 157, which generally serve to guide the hook portions 152, 154 for occlusion with the hook portions 142, 144 of the mating closure element. The guide surfaces 147, 157 may have a rounded crown surface. In addition, the hooks may be designed so that the hooks 144, 154 adjacent the interior of the container provide a greater resistance to opening of the closure device.

The fastening strip 132 may include a web 160 and a web 161. The web 160 may be located above the web 150 and the web 161 may be located below the web 151. The web 160 may include a first portion 162 and a guide portion 164 to provide a guide surface for the web 140. The web 161 may include a first portion 166 and a guide portion 168 to provide a guide surface for the web 141. The webs 160, 161 may improve seal integrity along the side seals of the bag. The webs 160, 161 may provide thermoplastic material to fill voids in the side seal region.

The fastening strip 130 may include one or more protrusions 170, 172. The protrusions 170, 172 may operate as a color enhancement member as described in U.S. Pat. No. 4,829,641 which is incorporated herein in its entirety. The protrusions 170, 172 may also provide extra material to improve the quality of the side seal during heat sealing of the side seal. In another embodiment, the fastening strip 132 may include one or more protrusions.

The fastening strips and the sidewalls may be formed from thermoplastic materials. In one embodiment, the sidewalls may be formed as a separate piece and then the fastening strips may be extruded onto the sidewalls. In another embodiment, the fastening strips and sidewalls may be formed as separate pieces and then connected by heat sealing or any other suitable connecting process. In another embodiment, the fastening strips and the sidewalls may be integrally formed by extrusion as a single piece.

Figure 4:
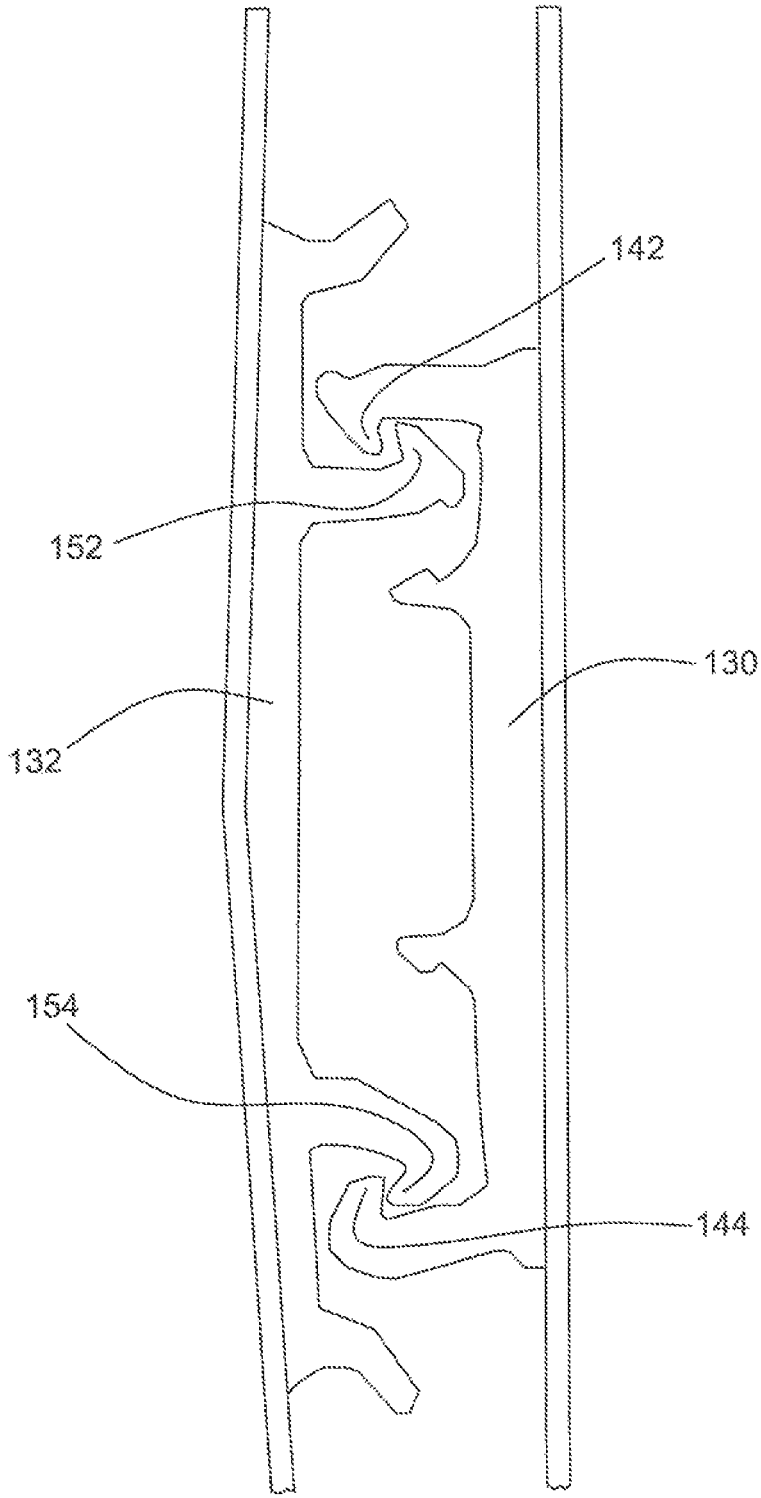
FIG. 4 is a cross-sectional view of the fastening strips in the occluded position.

To engage the first and second fastening strips 130, 132, a force 180 is applied to the fastening strips. The force 180 may be a user utilizing his or her fingers to press the fastening strips together. The first and second interlocking fastening strips 130, 132 are pressed toward each other until the guide surfaces 146, 147 contact the guide surfaces 156, 157. Due to the flexible characteristic of the thermoplastic fastening strip material, contact between the guide surfaces causes the webs 140, 141 to flex outwardly and the webs 150, 151 to flex inwardly. The hooks 142, 144 on the webs 140, 141 and the hooks 152, 154 on the webs 150, 151 can thereby slide past each other. Once past each other, the flexible characteristic of the fastening strip material causes the webs to flex back moving the hooks into an interlocking engagement with each other as shown in FIG. 4. Furthermore, because of the flexible and resilient characteristics of the fastening strip material, a sufficient pulling force can disengage the fastening strips.

The occlusion force 180 may have a first range from about 200 grams to about 1500 grams, a second range from about 400 grams to about 1100 grams, and a third range from about 500 grams to about 1000 grams. In one embodiment, the occlusion force 180 may be 800 grams. The occlusion force 180 was measured using the following test method.

Occlusion Force Test Method

Performed on an MTS RT/5 machine in order to evaluate the force required to occlude closure elements by point contact.

Cross head speed (compression): 1.0 inches per minute (2.54 cm per minute).

Occlusion Probe: Attached to crosshead. Contact area (uncompressed) 0.5 inches (1.27 cm)×0.5 inches (1.27 cm).

Probe composition: Natural or synthetic rubber with a hardness of Shore A 50-55.

Occlusion Plate: Substantially flat surface rigidly mounted to frame perpendicular to crosshead travel.

Break sensitivity: 90%.

Load Limit: 15 lbf (66.7 newtons).

Load cell: 250 newtons.

Figure 5:
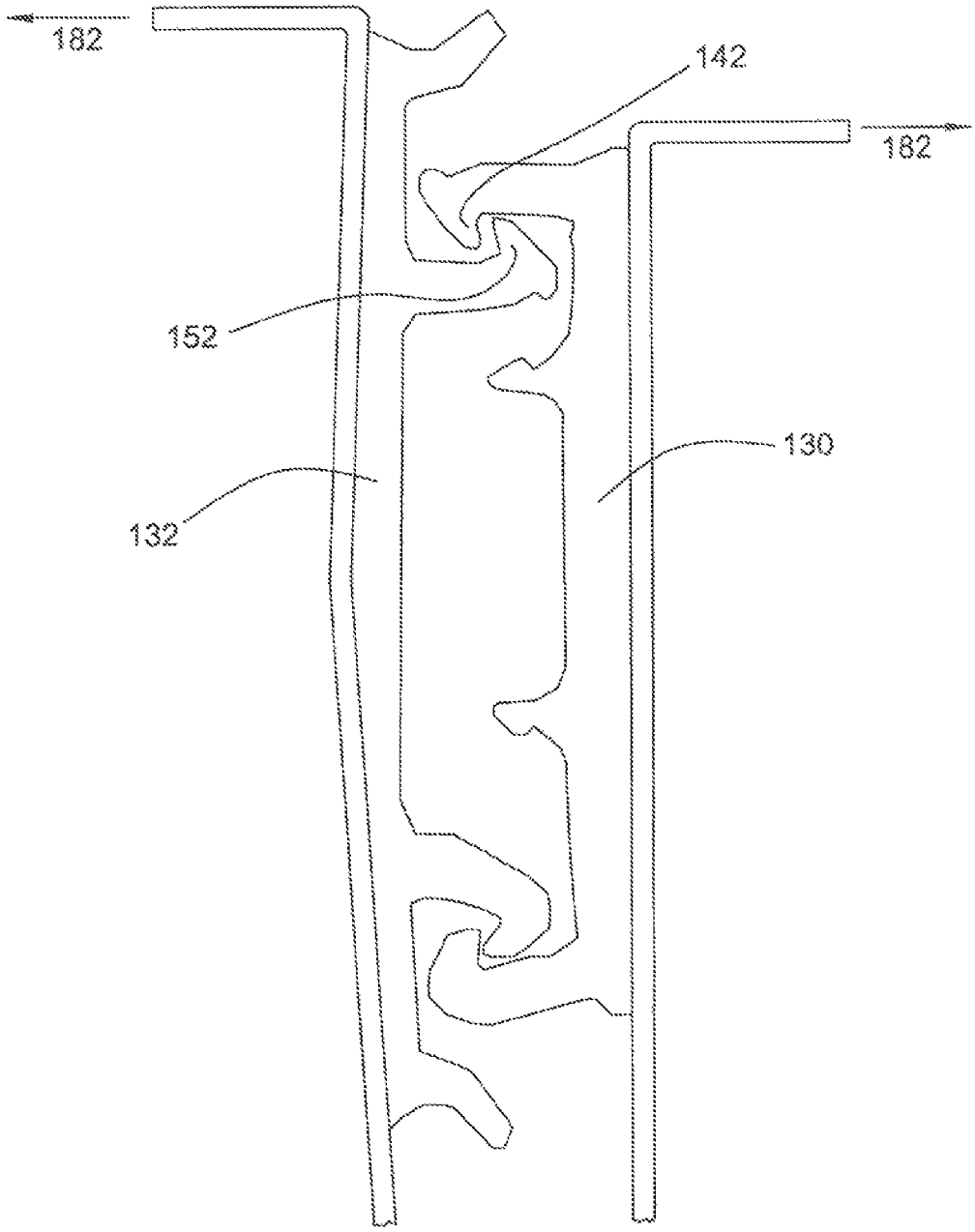
FIG. 5 is a cross-sectional view of the fastening strips prior to being deoccluded or opened.
Figure 6:
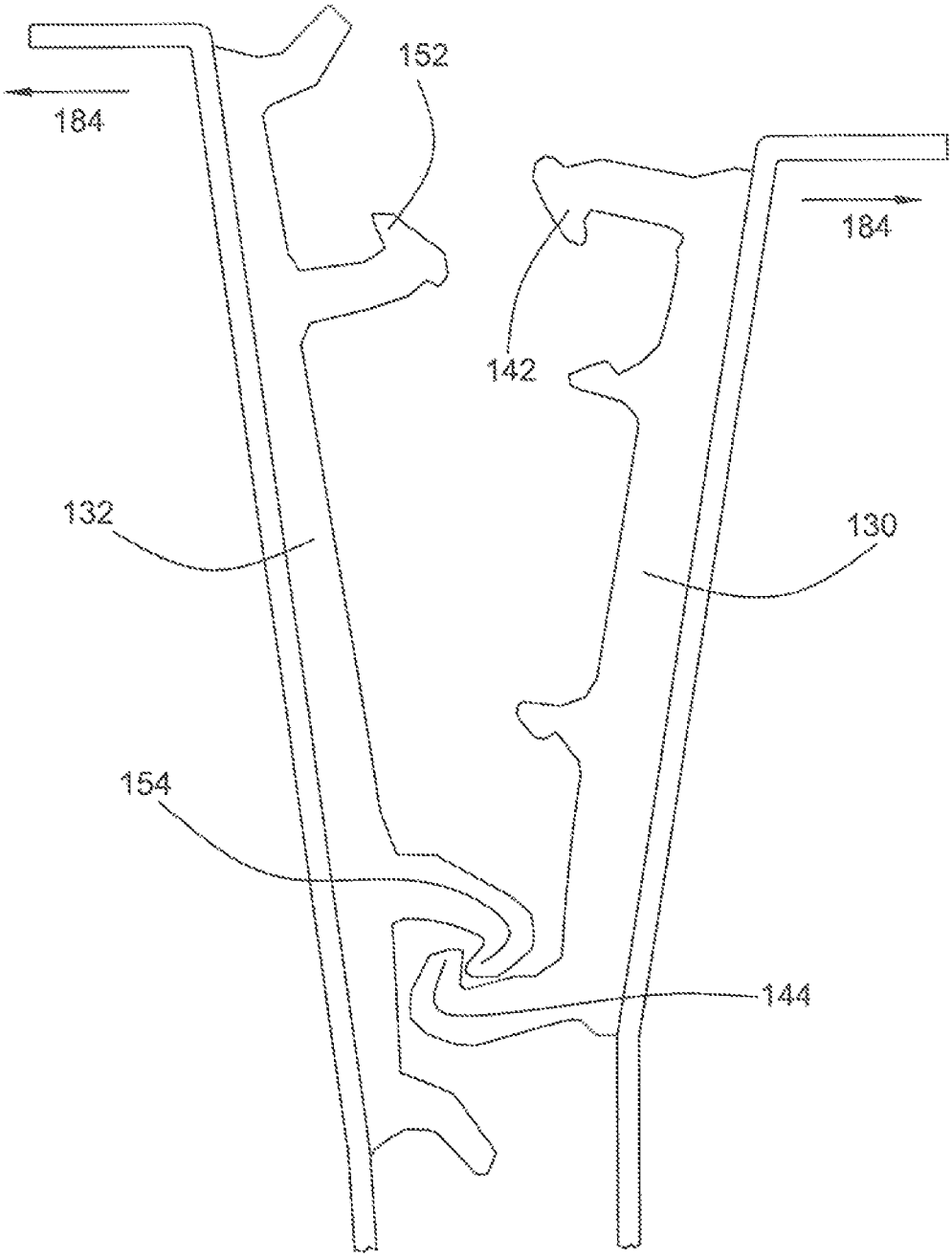
FIG. 6 is a cross-sectional view of the fastening strips with the top hooks disengaged.

The operator positions aligned and unoccluded closure elements on occlusion plate centered under occlusion probe. The operator activates the test machine and the occlusion probe moves toward the occlusion plate and occludes the closure elements. The operator tests five points of occlusion along the length of a one gallon (3.8 liters) bag (approximate length 10.5 inches (26.7 cm)). The operator verifies peak load computed by program on testing machine Referring to FIG. 5, the fastening strips 130, 132 may be separated by applying a force 182. The force 182 may be a user utilizing their fingers to grasp the tops of the sidewalls with their fingers and pulling outward. When the force 182 is applied, the upper or outside hooks 142, 152 disengage or open as shown in FIG. 6. The outside hook opening force 182 may have a first range from about 454 grams to about 3630 grams, a second range from about 907 grams to about 2722 grams, and a third range from about 1814 grams to about 2722 grams. In one embodiment, the outside hook opening force 182 may be 2041 grams. The outside hook opening force 182 was measured using the test method for force 184 which is described herein.

Figure 7:
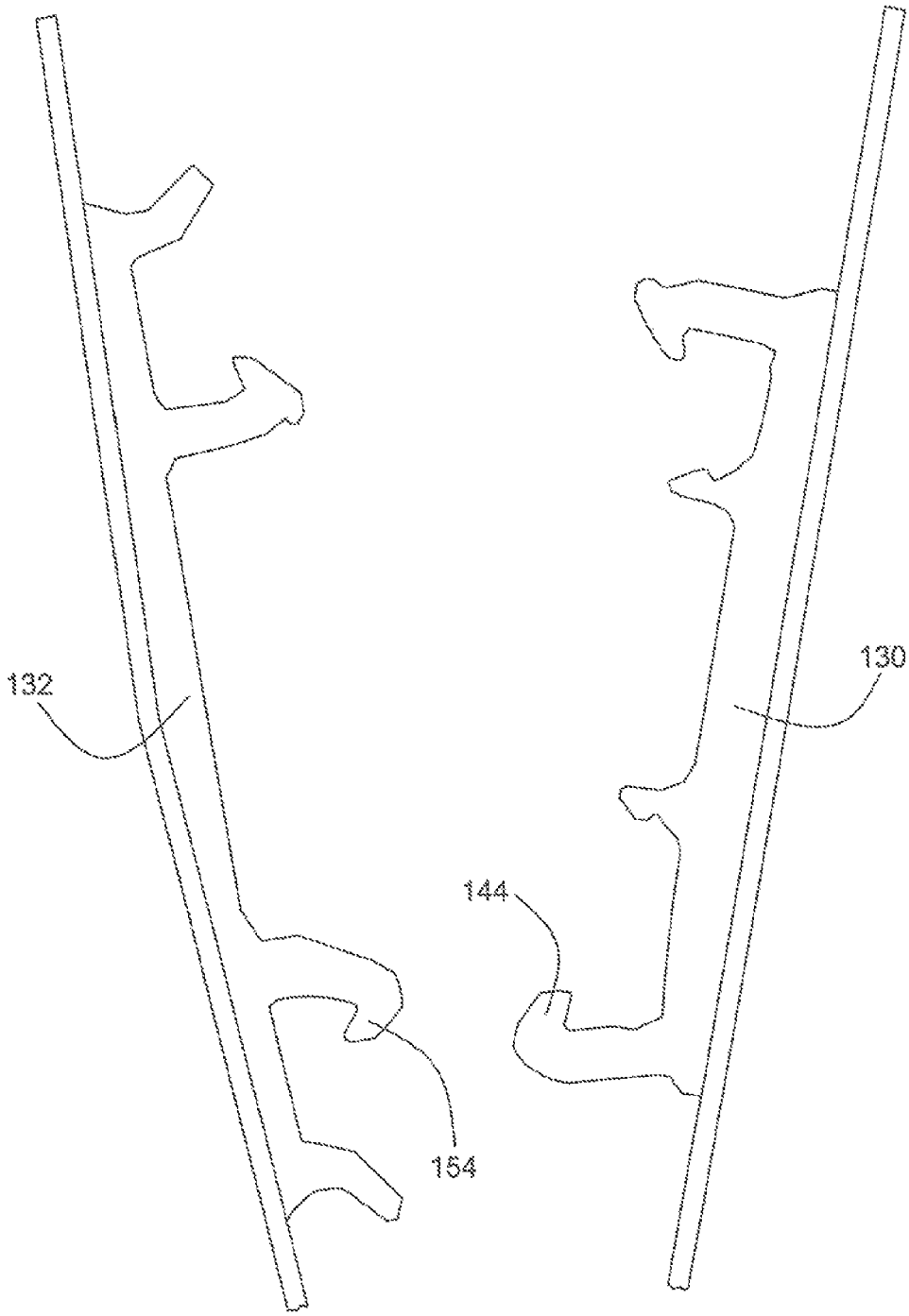
FIG. 7 is a cross-sectional view of the fastening strips with the top hooks and bottom hooks disengaged.

Referring to FIG. 6, as the user continues to apply an outward force 184, the lower or inside hooks 144, 154 disengage or open as shown in FIG. 7. The inside hook opening force 184 (after the outside hooks are opened) may have a first range from about 454 grams to about 3630 grams, a second range from about 907 grams to about 2722 grams, and a third range from about 1814 grams to about 2722 grams. In one embodiment, the inside hook opening force 184 may be 2041 grams. The inside hook opening force 184 was measured using the following test method.

Opening Force Test Method

Performed on an MTS Insight machine in order to evaluate the force required to separate the closure elements while gripping the sidewall near the closure elements.

Cross head speed (tension): 20.0 inches per minute (50.8 cm/minute).

Jaw type: Knurled face 1.0 inch (2.54 cm)×1.5 inch (3.81 cm).

Jaw Separation: 1.0 inch (2.54 cm).

Cross head extension limit: 3.1 inches 7.87 cm).

Load cell: 250 newtons.

The first sidewall of the bag is clamped into the first set of jaws for the test machine. The second sidewall of the bag is clamped into the second set of jaws for the test machine. The surface of the jaws are placed 0.30 inches (0.76 cm) or less from the edge of the closure on each sidewall. The operator activates the test machine and the first set of jaws moves away from the second set of jaws and deoccludes the closure elements. The operator identifies peak 1 force and peak 2 force on load vs. extension curve. Peak 1 force represents force 182. Peak 2 force represents force 184. The test is performed on six bags. The operator calculates the average loads for each peak.

The closure design may be modified to change the forces of each peak force independent of one another. For example, peak 1 force (force 182) may be equal to peak 2 force (force 184). In a second example, peak 1 force (force 182) may be greater than peak 2 force (force 184). In a third example, peak 1 force (force 182) may be less than peak 2 force (force 184).

Figure 8:
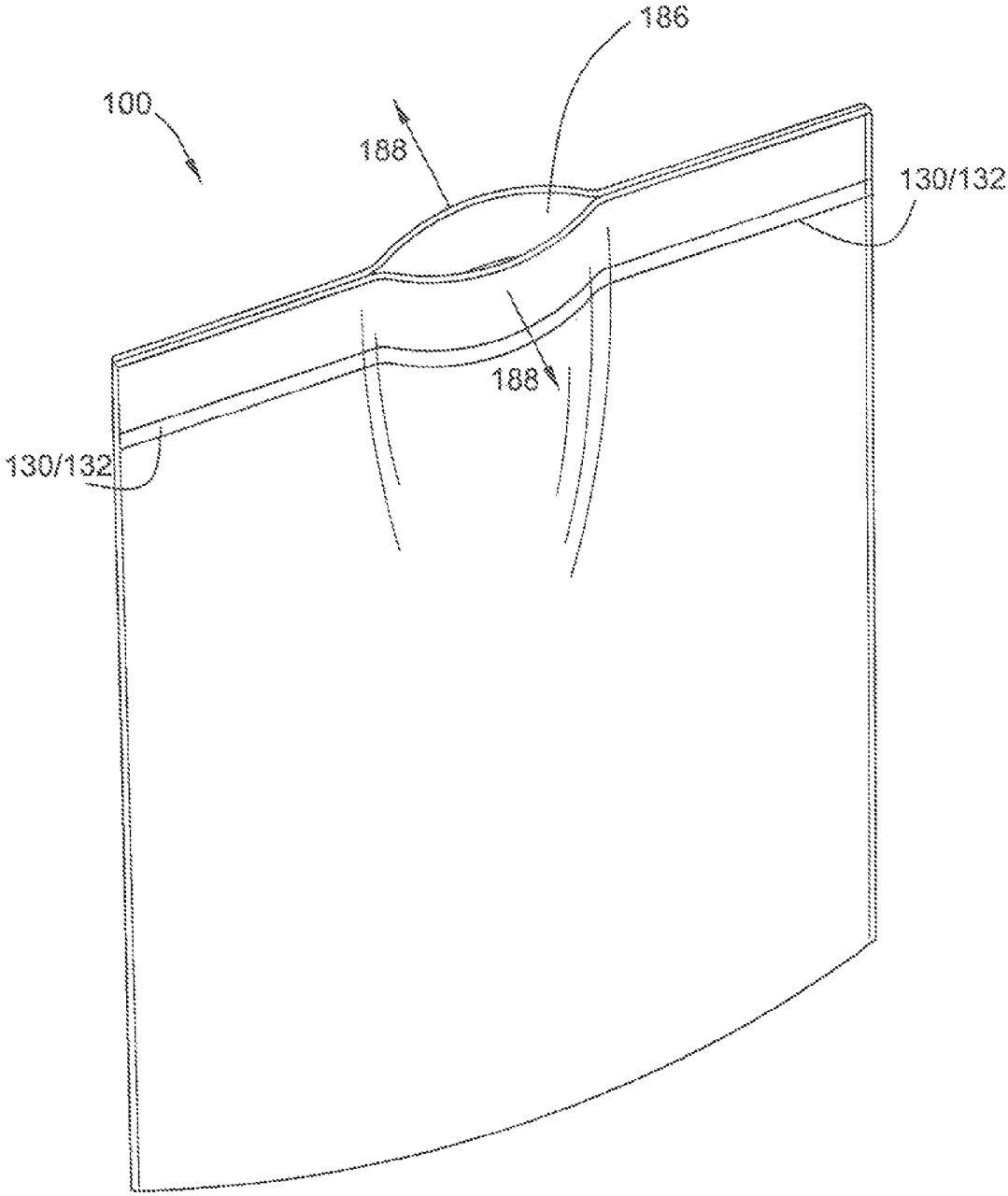
FIG. 8 is a perspective view of a bag with the fastening strips partially open.

Referring to FIG. 8, after the user disengages the upper and lower hooks, the bag 100 may have a small opening 186 and the fastening strips 130, 132 to the left and right of the opening may be engaged or occluded. In order to enlarge the opening 186, the user will apply a force 188 which will cause the fastening strips 130, 132 to the left and/or right of the opening to disengage or deocclude. The peel force 188 may have a first range from about 20 grams to about 80 grams, a second range from about 30 grams to about 65 grams, and a third range from about 40 grams to about 60 grams. In one embodiment, the peel force may be 55 grams. The peel force 188 was measured using the test method noted herein for force 182 and force 184. The peel force is the average force over the extension length and includes Peak 1 and Peak 2.

Figure 9:
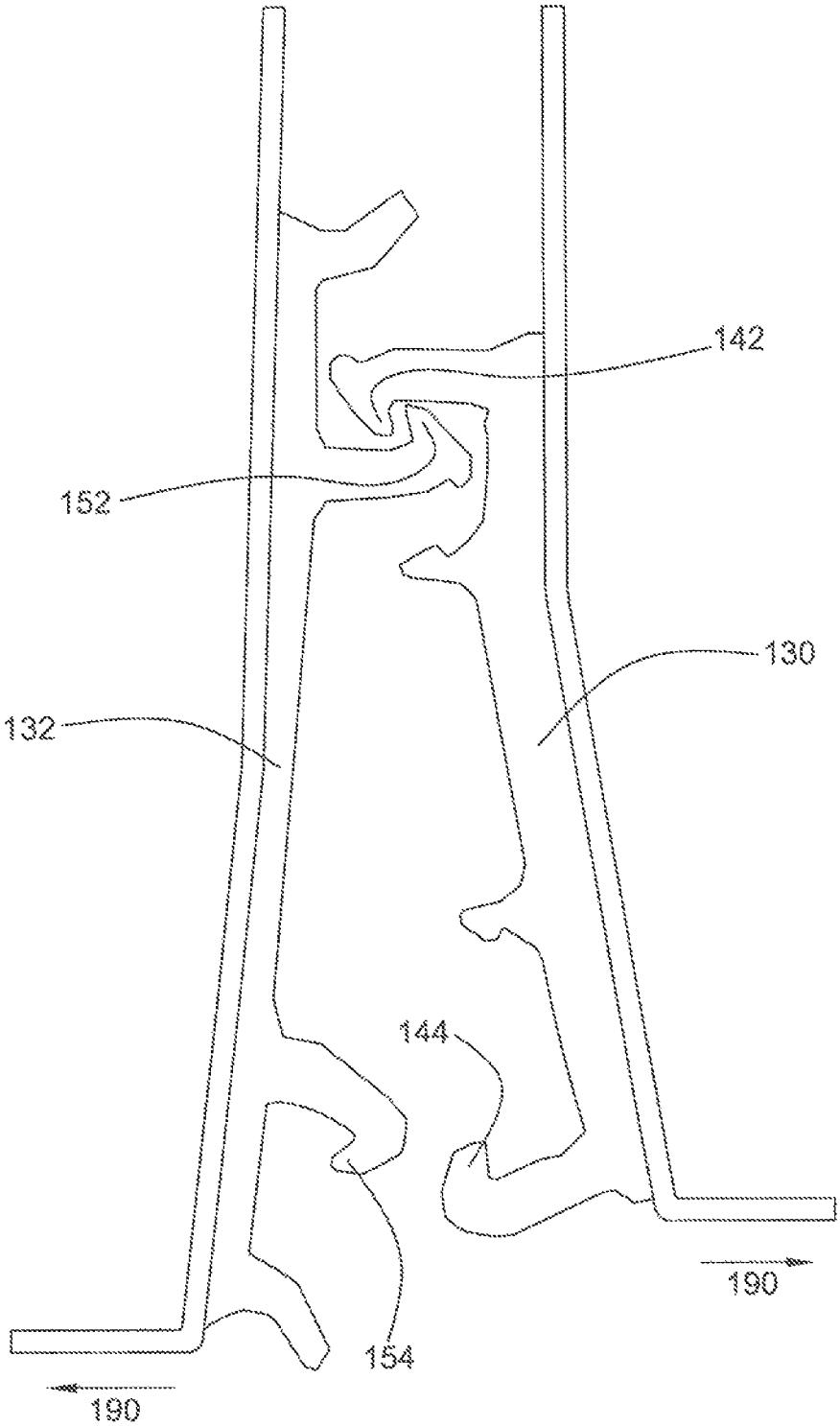
FIG. 9 is a cross-sectional view of the fastening strips with the bottom hooks disengaged.
Figure 11:
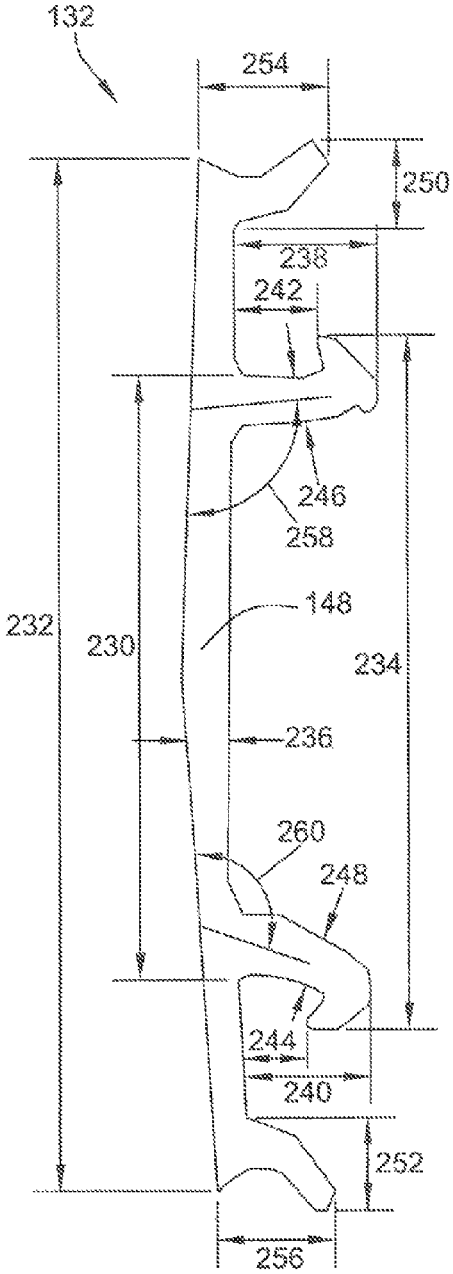
FIG. 11 is a cross-sectional view of a male fastening strip.
Figure 10:
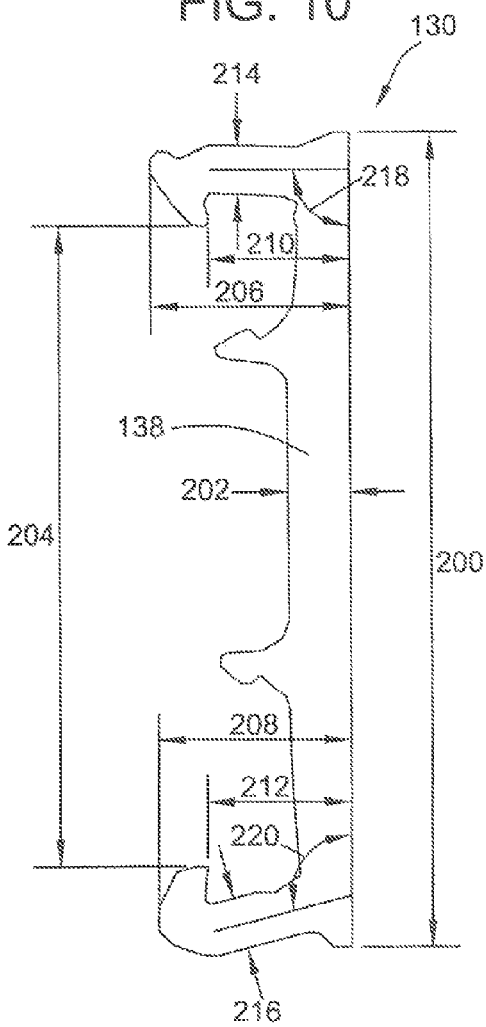
FIG. 10 is a cross-sectional view of the female fastening strip.

Referring to FIG. 9, the inside hooks 144, 154 may be disengaged or opened by applying a force 190. The force to open or disengage the inside hooks 144, 154 may be greater than the force to open or disengage the outside hooks 142, 152. The inside hook opening force 190 may be greater in order to prevent the contents of the bag from unintentionally escaping from the bag. For example, the bag may include food items and air. If a force was applied to the sidewalls of the bag, such as, by accidental crushing of the bag, then the air pushing on the sidewalls may cause the inside hooks (and outside hooks) to unintentionally open. A high inside hook opening force may reduce this unintentional opening. The inside hook opening force 190 may have a first range from about 900 grams to about 5443 grams, a second range from about 1361 grams to about 4536 grams, and a third range from about 1814 grams to about 3629 grams. In one embodiment, the inside hook opening force 190 may be 2721 grams. The inside hook opening force 190 was measured using test method described herein for force 184. The operator cuts the sidewalls of the bag 1 inch (2.54 cm) below and parallel to the fastening strips and clamps the sidewalls into the jaws as noted in the test method.

The forces may be expressed as a ratio with respect to each other. The ratio of the opening force to the occlusion force may have a first range from about 0.3:1 to about 18.2:1, and a second range from about 0.8:1 to about 6.8:1. In one embodiment, the ratio may be 2.6:1. The opening force is the greater of the peak 1 force and the peak 2 force. The ratio of the inside opening force (from the inside) to the occlusion force may have a first range from about 0.6:1 to about 27.2:1, and a second range from about 1.6:1 to about 9.1:1. In one embodiment, the ratio may be 3.4:1. The ratio of the opening force to the inside opening force (from the inside) may have a first range from about 0.1:1 to about 2.0:1, and a second range from about 0.2:1 to about 1.0:1. In one embodiment, the ratio may be 0.8:1.

The fastening strip 130 may have the following parameters:

| Reference Number | Range inches (cm) | Example inches (cm) |
|---|---|---|
| 200 | 0.192 (0.488) to 0.288 (0.732) | 0.240 (0.61) |
| 202 | 0.006 (0.015) to 0.050 (0.127) | 0.010 (0.025) |
| 204 | 0.130 (0.330) to 0.218 (0.555) | 0.182 (0.462) |

-continued

| | | |
|---|---|---|
| 206 | 0.035 (0.089) to 0.076 (0.193) | 0.058 (0.147) |
| 208 | 0.035 (0.089) to 0.075 (0.191) | 0.058 (0.147) |
| 210 | 0.028 (0.071) to 0.048 (0.122) | 0.040 (0.102) |
| 212 | 0.028 (0.071) to 0.048 (0.122) | 0.040 (0.102) |
| 214 | 0.008 (0.020) to 0.020 (0.051) | 0.014 (0.036) |
| 216 | 0.009 (0.023) to 0.021 (0.053) | 0.015 (0.038) |

| Reference Number | Range | Range |
|---|---|---|
| 218 | 63 to 126 degrees | 90 degrees |
| 220 | 63 to 126 degrees | 90 degrees |

The fastening strip 132 may have the following parameters:

| Reference Number | Range inches (cm) | Example inches (cm) |
|---|---|---|
| 230 | 0.127 (0.324) to 0.218 (0.555) | 0.182 (0.462) |
| 232 | 0.200 (0.508) to 0.342 (0.869) | 0.285 (0.724) |
| 234 | 0.140 (0.356) to 0.240 (0.610) | 0.200 (0.508) |
| 236 | 0.006 (0.015) to 0.050 (0.127) | 0.010 (0.025) |
| 238 | 0.018 (0.046) to 0.042 (0.107) | 0.030 (0.076) |
| 240 | 0.018 (0.046) to 0.042 (0.107) | 0.030 (0.076) |
| 242 | 0.014 (0.036) to 0.034 (0.086) | 0.024 (0.061) |
| 244 | 0.014 (0.036) to 0.034 (0.086) | 0.024 (0.061) |
| 246 | 0.007 (0.018) to 0.015 (0.038) | 0.011 (0.028) |
| 248 | 0.007 (0.017) to 0.015 (0.039) | 0.011 (0.028) |
| 250 | 0.014 (0.036) to 0.024 (0.061) | 0.020 (0.051) |
| 252 | 0.014 (0.036) to 0.024 (0.061) | 0.020 (0.051) |
| 254 | 0.024 (0.61) to 0.041 (0.104) | 0.034 (0.086) |
| 256 | 0.024 (0.61) to 0.041 (0.104) | 0.034 (0.086) |

| Reference Number | Range | Range |
|---|---|---|
| 258 | 63 to 126 degrees | 90 degrees |
| 260 | 63 degrees to 126 degrees | 90 degrees |

The fastening strip 130 has a width 200 and the fastening strip 132 has a width 232. The wide fastening strips 130, 132 provide a greater surface area for the user to apply a force during the occlusion process. The base 138 of the fastening strip 130 has a thickness 202 and the base 148 of the fastening strip 132 has a thickness 236. Improved occlusion may be experienced due to the thick bases. This allows for the occlusion force to be transmitted over a larger area, and may reduce the occlusion effort. The thickness of the bases may be adjusted to impact properties, such as, opening force, occlusion force, perception of seal strength, and/or cost savings due to material reduction.

The reduced occlusion force may be provided by the closure element geometry, such as, the closure leg designs and the hook designs. The reduced occlusion force may be provided by the wide fastening strips. The wide fastening strips may exhibit reduced resistance to bending during the occlusion process and thus may allow for easier occlusion.

The fastening strips may have improved alignment. The improved alignment may be provided by the wide fastening strips, the spacing between the webs, the geometry of the closure elements, and/or the thick base of the fastening strips. The wide spacing of the webs may minimize out of alignment conditions which may result in difficulty of occlusion or misalignment of the fastening strips.

The user perceives seal security by the opening force of the fastening strips and the peel force of the fastening strips. The fastening strips may have a high opening force and a high peel force. Thus, the user may have an improved perception of seal security. Also the user may be less likely to have unintentional openings.

Figure 13:
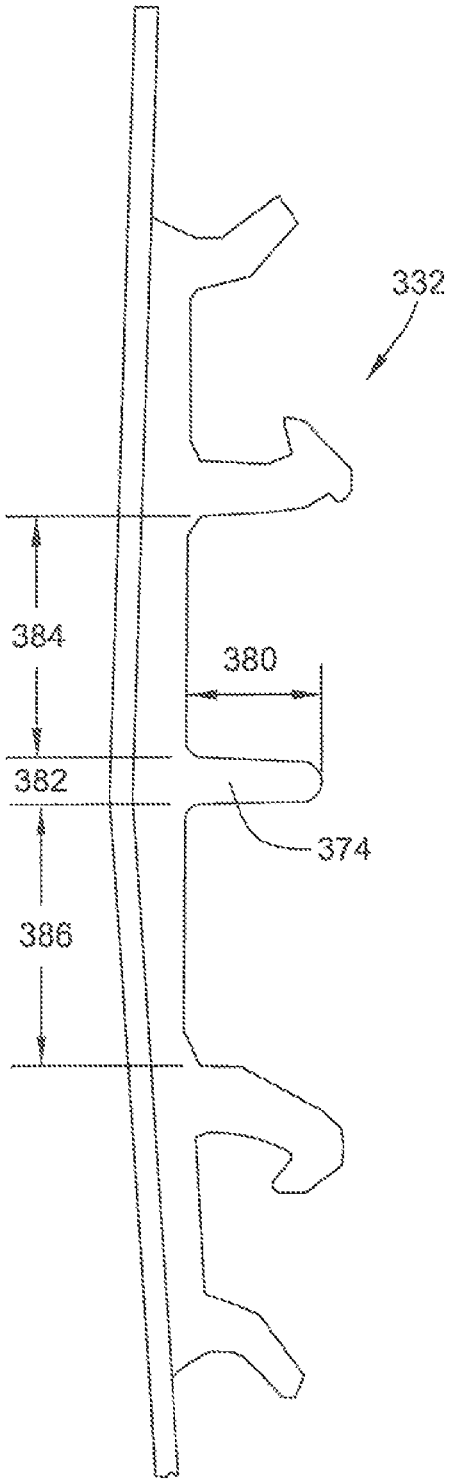
FIG. 13 is a cross-sectional view of another embodiment of a male fastening strip.
Figure 12:
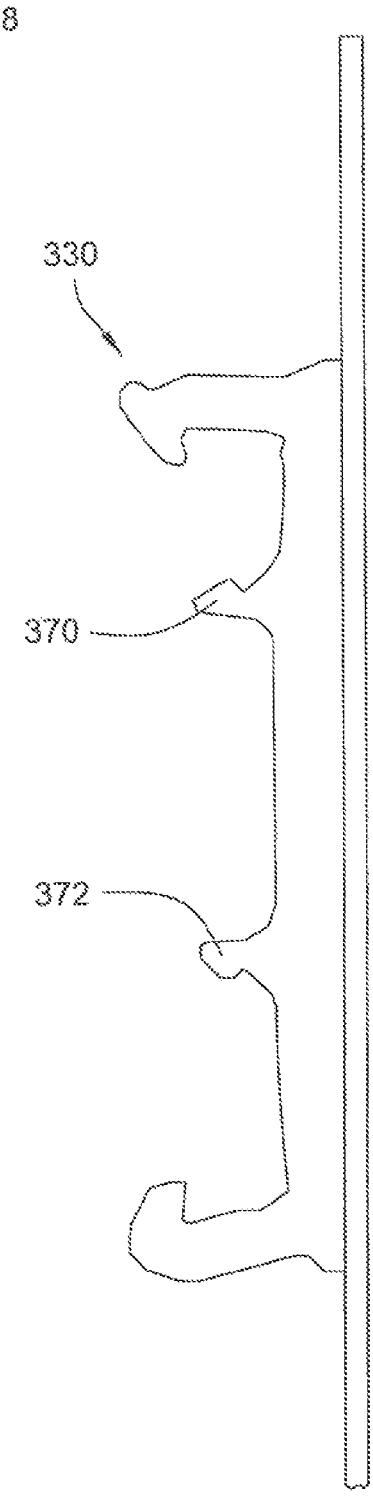
FIG. 12 is cross-sectional view of another embodiment of a female fastening strip.

Referring to FIGS. 12 and 13, another embodiment of a closure device 328 is shown. The closure device 328 may include first and second fastening strips 330, 332. The first fastening strip 330 may be similar to the fastening strip 130. The second fastening strip 332 may be similar to the fastening strip 132 except that the second fastening strip 332 may include a web 374. The web 374 may provide additional thermoplastic material to be used during the side sealing process as noted herein. When the fastening strips 330, 332 are occluded, the web 374 may be positioned between the protrusion 370 and protrusion 372 on the first fastening strip 330.

The fastening strip 332 may have the following parameters:

| Reference Number | Range inches (cm) | Example inches (cm) |
|---|---|---|
| 380 | 0.016 (0.041) to 0.033 (0.083) | 0.023 (0.059) |
| 382 | 0.006 (0.016) to 0.013 (0.032) | 0.009 (0.023) |
| 384 | 0.061 (0.154) to 0.121 (0.308) | 0.087 (0.220) |
| 386 | 0.061 (0.154) to 0.121 (0.308) | 0.087 (0.220) |

Figure 15:
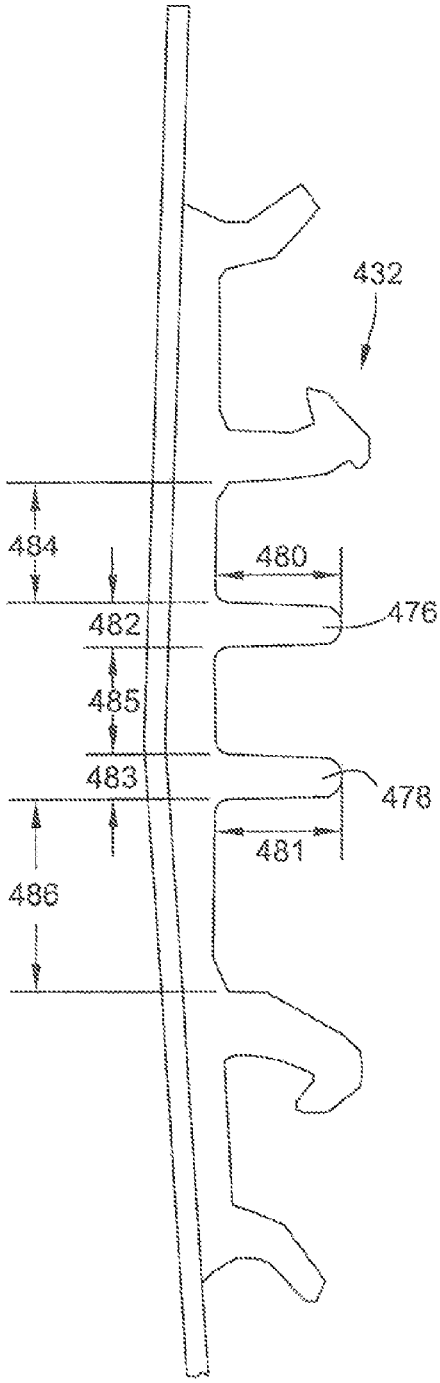
FIG. 15 is a cross-sectional view of another embodiment of a male fastening strip.
Figure 14:
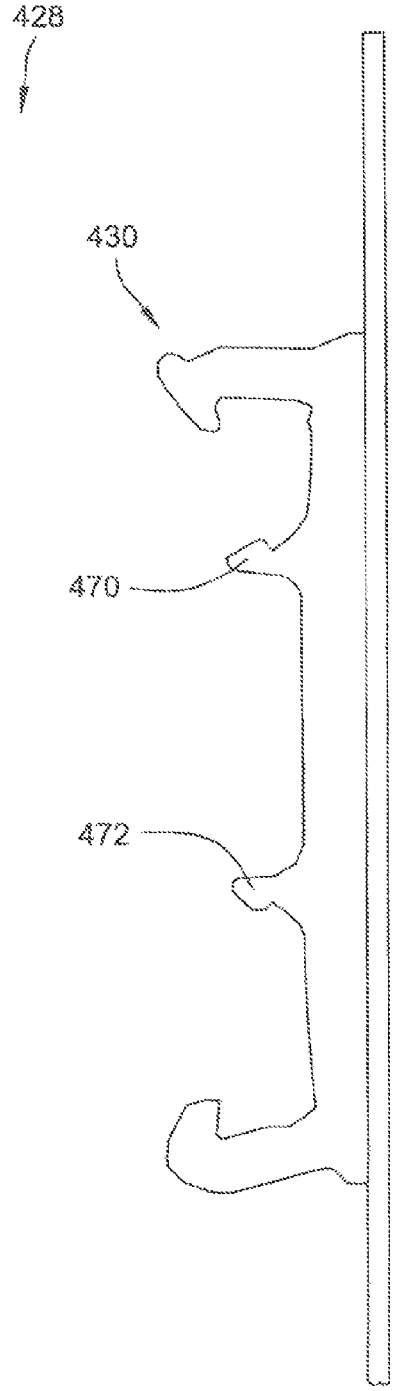
FIG. 14 is a cross-sectional view of another embodiment of a female fastening strip.

Referring to FIGS. 14 and 15, another embodiment of a closure device 428 is shown. The closure device 428 may include first and second fastening strips 430, 432. The first fastening strip 430 may be similar to the fastening strip 130. The second fastening strip 432 may be similar to the fastening strip 132 except that the second fastening strip 432 may include a web 476 and a web 478. The webs 476, 478 may provide additional thermoplastic material to be used during the side sealing process. When the fastening strips 430, 432 are occluded, the webs 476, 478 may be positioned between the protrusion 470 and protrusion 472 on the first fastening strip 430.

The fastening strip 432 may have the following parameters:

| Reference Number | Range inches (cm) | Example inches (cm) |
|---|---|---|
| 480 | 0.016 (0.041) to 0.033 (0.083) | 0.023 (0.059) |
| 481 | 0.016 (0.041) to 0.033 (0.083) | 0.023 (0.059) |
| 482 | 0.006 (0.015) to 0.012 (0.031) | 0.009 (0.022) |
| 483 | 0.006 (0.015) to 0.012 (0.031) | 0.009 (0.022) |
| 484 | 0.035 (0.089) to 0.070 (0.178) | 0.050 (0.127) |
| 485 | 0.032 (0.080) to 0.063 (0.160) | 0.045 (0.114) |
| 486 | 0.035 (0.089) to 0.070 (0.178) | 0.050 (0.127) |

Figure 16:
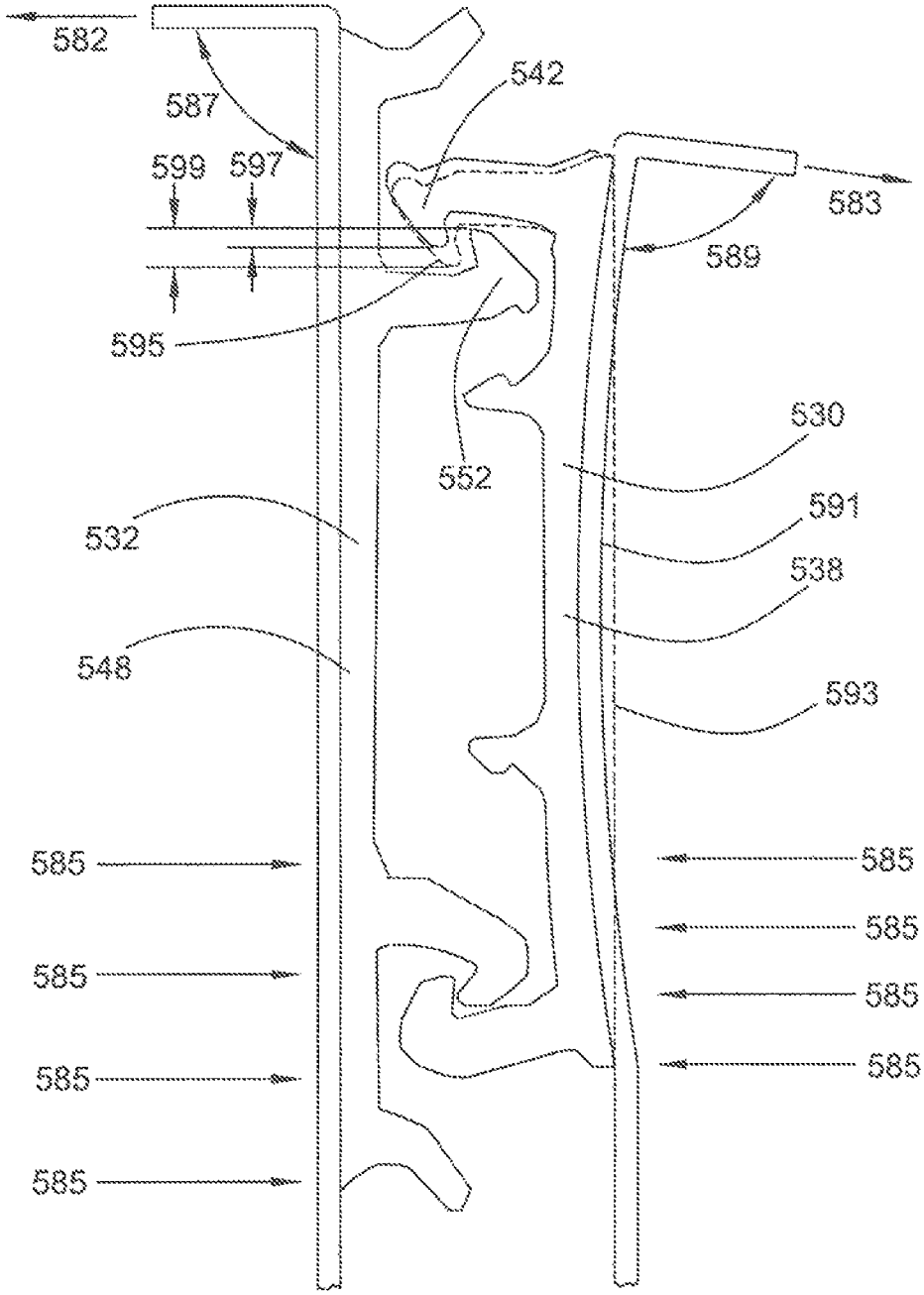
FIG. 16 is a cross-sectional view of another embodiment of the fastening strips being deoccluded.

Referring to FIG. 16, a user may bend the closure open rather than pulling the closure open. The fastening strips 530, 532 may be similar to fastening strips 130, 132 except that the base portion 538 may have less thickness than the base portion 548. The fastening strips 530, 532 may be separated by applying forces 582, 583, 585 to the bag. The forces 582, 583 may be a user utilizing their fingers to grasp the tops of the sidewalls with their fingers. The force 585 may be a user applying their fingers to the sidewalls near the bottoms of the fastening strips. The force 582 may be directed outward at an angle 587 of approximately 90 degrees with respect to the fastening strip 532. The force 583 may be directed outward and downward at an angle 589 with respect to the fastening strip 530. The angle 589 may have a range of about 30 degrees to about 80 degrees. In one embodiment, the angle 589 may be 50 degrees.

The force 583 may cause the base portion 538 to bend. The bottom 591 of the base portion 538 is shown in a bent position. The dashed line 593 shows the bottom 591 is an unbent position.

Figure 17:
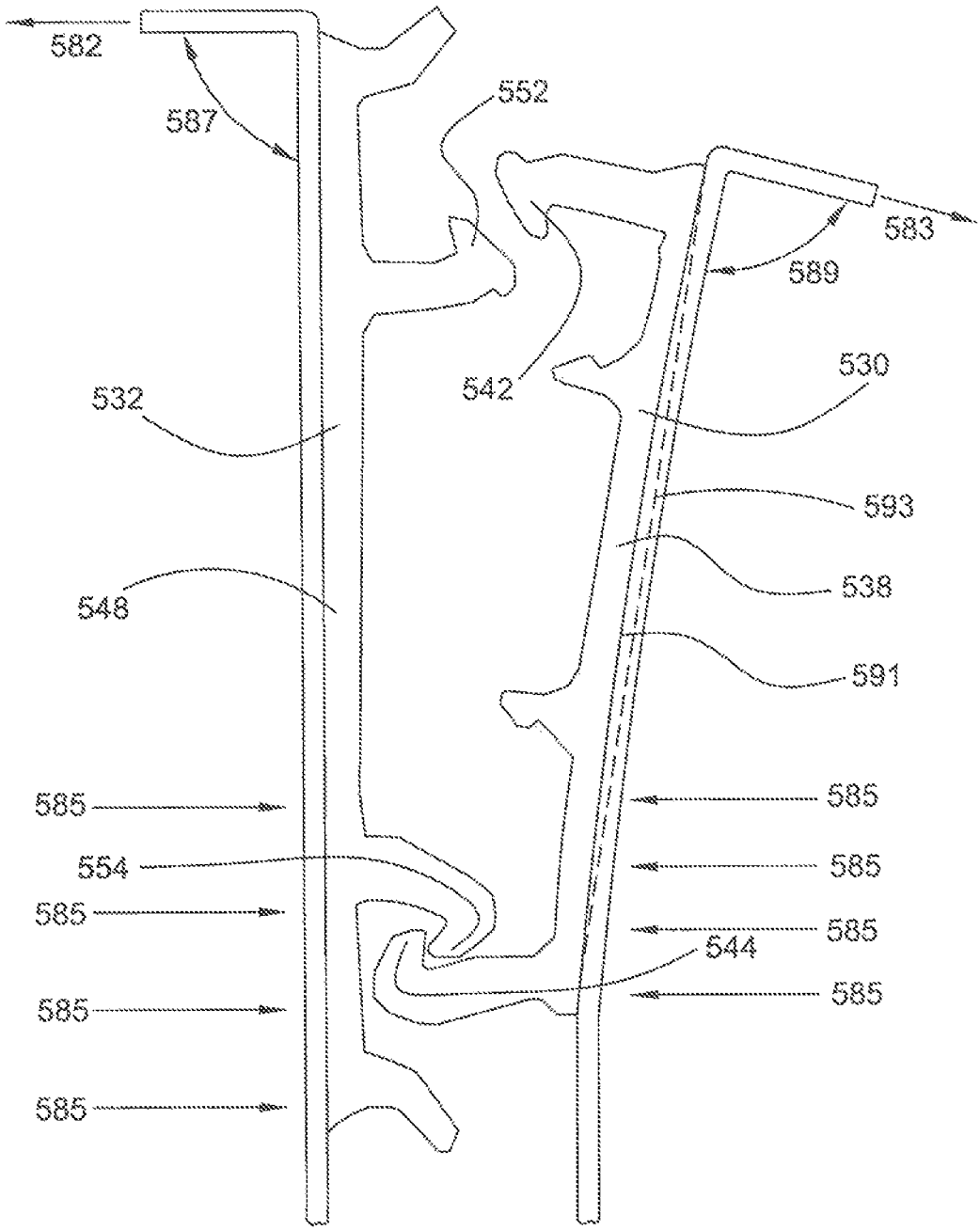
FIG. 17 is a cross-sectional view of the fastening strips in FIG. 16 with the top hooks disengaged.

The bending of the fastening strip 530 allows the upper hook portion 542 to move upward relative to the upper hook portion 552. The position of the upper hook portion 542 prior to bending is shown with dashed line 595. By moving the hook portion 542 upward, the hook portions 542, 552 have an engagement distance 597 which is less than the prior engagement distance 599 without bending. Thus, less force is required to disengage hook portions 542, 552 than if the hook portion 542 did not move upward. The upper hook portions 542, 552 are shown disengaged or deoccluded in FIG. 17. As the user continues to apply the forces 582, 583, the lower or inside hooks 544, 554 disengage or deocclude. The wide base portions may provide the user with greater leverage to bend the closure open.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments are described herein. Variations of those embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A thermoplastic bag for storing food comprising:

a first sidewall of pliable thermoplastic material;

a second sidewall of pliable thermoplastic material overlaid and joined to the first sidewall along a first edge, a second edge, and a closed bottom edge, the first and second sidewalls un-joined along respective top edges to provide an opening opposite the bottom edge for accessing the interior volume;

a first wide fastening strip attached to the first sidewall proximate the opening, the first fastening strip includes a first closure element, the first closure element includes a base portion, the base portion includes a first web and a second web extending from the base portion, the first web includes a first hook portion, the second web includes a second hook portion, the first hook portion facing toward the second hook portion; and a second wide fastening strip attached to the second sidewall proximate the opening, the second fastening strip includes a second closure element, the second closure element includes a base portion, the base portion includes a third web and a fourth web extending from the base portion, the third web includes a third hook portion, the fourth web includes a fourth hook portion, the third hook portion facing away from the fourth hook portion;

wherein the first wide fastening strip has a first width of the fastening strip and a first height of the first hook portion from the base to the top of the hook and the ratio of the first width to the first height is greater than three;

wherein the second wide fastening strip has a second width of the fastening strip and a second height of the third hook portion from the base to the top of the hook and the ratio of the second width to the second height is greater than five; wherein the first fastening strip has a ratio of the first width to the first height of five or greater; and wherein the first hook portion and the second hook portion of the first fastening strip and the third hook portion and the fourth hook portion of second fastening strip are occluded with an occlusion force, the occlusion force is between about 200 grams and about 1500 grams.

2. The thermoplastic bag of claim 1, wherein the second fastening strip has a ratio of the second width to the second height greater than six.

3. The thermoplastic bag of claim 1, wherein the second closure element includes a fifth web extending from the base portion between the third web and the fourth web, the fifth web provides additional material in the form of a single post.

4. The thermoplastic bag of claim 1, wherein the first closure element includes a pair of protrusions between the first hook portion and the second hook portion.

5. The thermoplastic bag of claim 1, wherein the first width is between about 0.192 inches (0.488 cm) and about 0.288 inches (0.732 cm); and the second width is between about 0.200 inches (0.508 cm) and about 0.342 inches (0.869 cm).

6. A thermoplastic bag for storing food comprising:

a first sidewall of pliable thermoplastic material;

a second sidewall of pliable thermoplastic material overlaid and joined to the first sidewall along a first edge, a second edge, and a closed bottom edge, the first and second sidewalls un-joined along respective top edges to provide an opening opposite the bottom edge for accessing the interior volume;

a first wide fastening strip attached to the first sidewall proximate the opening, the first fastening strip includes a first closure element, the first closure element includes a base portion, the base portion includes a first web and a second web extending from the base portion, the first web includes a first hook portion, the second web includes a second hook portion, the first hook portion facing toward the second hook portion; and a second wide fastening strip attached to the second sidewall proximate the opening, the second fastening strip includes a second closure element, the second closure element includes a base portion, the base portion includes a third web and a fourth web extending from the base portion, the third web includes a third hook portion, the fourth web includes a fourth hook portion, the third hook portion facing away from the fourth hook portion;

wherein the second wide fastening strip has a second width of the fastening strip and a second height of the first hook portion from the base to the top of the hook and the ratio of the second width to the second height is greater than five; and wherein the first hook portion and the second hook portion of the first fastening strip and the third hook portion and the fourth hook portion of second fastening strip are occluded with an occlusion force, the occlusion force is between about 200 grams and about 1500 grams.

7. The thermoplastic bag of claim 6, wherein the first width is between about 0.192 inches (0.488 cm) and about 0.288 inches (0.732 cm) second width is between about 0.140 inches (0.356 cm) and about 0.240 inches (0.610 cm).

8. The thermoplastic bag of claim 6, wherein the second closure element includes a fifth web extending from the base portion between the third web and the fourth web, the fifth web provides additional material in the form of a single post.

9. The thermoplastic bag of claim 8, wherein the first closure element includes a pair of protrusions between the first hook portion and the second hook portion.

10. The thermoplastic bag of claim 9, wherein the first width is between about 0.192 inches (0.488 cm) and about 0.288 inches (0.732 cm) second width is between about 0.140 inches (0.356 cm) and about 0.240 inches (0.610 cm).

11. A thermoplastic bag for storing food comprising:

a first sidewall of pliable thermoplastic material;

a second sidewall of pliable thermoplastic material overlaid and joined to the first sidewall along a first edge, a second edge, and a closed bottom edge, the first and second sidewalls un-joined along respective top edges to provide an opening opposite the bottom edge for accessing the interior volume;

a first wide fastening strip attached to the first sidewall proximate the opening, the first fastening strip includes a first closure element, the first closure element includes a base portion, the base portion includes a first web and a second web extending from the base portion, the first web includes a first hook portion, the second web includes a second hook portion, the first hook portion facing toward the second hook portion; and a second wide fastening strip attached to the second sidewall proximate the opening, the second fastening strip includes a second closure element, the second closure element includes a base portion, the base portion includes a third web and a fourth web extending from the base portion, the third web includes a third hook portion, the fourth web includes a fourth hook portion, the third hook portion facing away from the fourth hook portion;

wherein the first wide fastening strip has a width of the fastening strip and a height of the first hook portion from the base to the top of the hook and the ratio of the width to the height is greater than three;

wherein the second wide fastening strip has a width of the fastening strip and a height of the third hook portion from the base to the top of the hook and the ratio of the width to the height is greater than five; and wherein the first hook portion and the second hook portion of the first fastening strip and the third hook portion and the forth hook portion of second fastening strip are occluded with an occlusion force, the occlusion force is between about 200 grams and about 1500 grams.

12. The thermoplastic bag of claim 11, wherein the second closure element includes a fifth web extending from the base portion between the third web and the fourth web, the fifth web provides additional material in the form of a single post.

13. The thermoplastic bag of claim 12, wherein the first closure element includes a pair of protrusions between the first hook portion and the second hook portion.

* * * * *